US008593382B2

(12) United States Patent
Kimura

(10) Patent No.: US 8,593,382 B2
(45) Date of Patent: Nov. 26, 2013

(54) LIQUID CRYSTAL DISPLAY DEVICE

(75) Inventor: Hiroaki Kimura, Kawasaki (JP)

(73) Assignee: NLT Technologies, Ltd., Kanagawa (JP)

( * ) Notice: Subject to any disclaimer, the term of this patent is extended or adjusted under 35 U.S.C. 154(b) by 1574 days.

(21) Appl. No.: 11/855,171

(22) Filed: Sep. 14, 2007

(65) Prior Publication Data

US 2008/0074367 A1 Mar. 27, 2008

(30) Foreign Application Priority Data

Sep. 26, 2006 (JP) ..... 2006-261522

(51) Int. Cl.
*G09G 3/36* (2006.01)

(52) U.S. Cl.
USPC ..... 345/87

(58) Field of Classification Search
USPC ..... 345/98, 690, 87
See application file for complete search history.

(56) References Cited

U.S. PATENT DOCUMENTS

| | | | | |
|---|---|---|---|---|
| 7,202,908 | B2 * | 4/2007 | Zhou et al. | 348/452 |
| 2003/0156092 | A1 * | 8/2003 | Suzuki et al. | 345/98 |
| 2005/0068343 | A1 * | 3/2005 | Pan et al. | 345/690 |
| 2005/0184949 | A1 * | 8/2005 | Kamimura | 345/98 |
| 2005/0253793 | A1 * | 11/2005 | Chien et al. | 345/87 |
| 2006/0072664 | A1 | 4/2006 | Kwon et al. | |
| 2007/0063947 | A1 * | 3/2007 | Kang | 345/89 |
| 2008/0055229 | A1 * | 3/2008 | Shen et al. | 345/102 |
| 2008/0062185 | A1 * | 3/2008 | Gong et al. | 345/545 |
| 2008/0180385 | A1 * | 7/2008 | Yoshida et al. | 345/102 |

FOREIGN PATENT DOCUMENTS

| | | |
|---|---|---|
| JP | 04-288589 | 10/1992 |
| JP | 2002-23707 | 1/2002 |
| JP | 2002-169514 | 6/2002 |
| JP | 2004-117527 | 4/2004 |
| JP | 2004-233949 | 8/2004 |
| JP | 2005-091454 | 4/2005 |
| JP | 2005-309326 | 11/2005 |

OTHER PUBLICATIONS

Japanese Office Action issued Apr. 17, 2012 by the Japanese Patent Office in the corresponding Japanese Patent Application No. 2007-250056, with English translation, 5 pages.
Chinese Official Action—200710161242.9—Mar. 30, 2011.

* cited by examiner

*Primary Examiner* — Quan-Zhen Wang
*Assistant Examiner* — Tony Davis
(74) *Attorney, Agent, or Firm* — Young & Thompson

(57) ABSTRACT

It is to make the sizes of "blur" in a moving image uniform in a liquid crystal display unit of a hold-type display device by suppressing deformations and discolorations of the moving image caused due to ununiformity in the response speed of the liquid crystal panel. The display device includes a frame memory and a correction frame signal generating device as correction frame signal generating devices which compare pixel gradation levels defined by one frame and a frame one before among the image signals inputted from the outside, and generate an image signal of a correction frame for reducing a delay in the response time of the pixel. At the same time, the liquid crystal display device displays the correction frame on the liquid crystal panel between that one frame and the frame one before.

25 Claims, 12 Drawing Sheets

CHARACTERISTICS OF PANEL HAVING LARGE DIFFERENCE IN LIQUID CRYSTAL RESPONSE SPEED BETWEEN ON AND OFF STATES

NORMALLY-WHITE (TN)

(i) LIQUID CRYSTAL RESPONSE

NORMALLY-BLACK (IPS,VA)

(i) LIQUID CRYSTAL RESPONSE

CHARACTERISTICS OF PANEL HAVING LARGE DIFFERENCE IN LIQUID CRYSTAL RESPONSE SPEED BETWEEN ON AND OFF STATES

CASE OF VA PANEL WITH OVERSHOOT (i) LIQUID CRYSTAL RESPONSE

CASE OF TN PANEL WITH OVERSHOOT (i) LIQUID CRYSTAL RESPONSE

LIQUID CRYSTAL DISPLAY DEVICE

This application is based upon and claims the benefit of priority from Japanese patent application No. 2006-261522, filed on Sep. 26, 2006, the disclosure of which is incorporated herein in its entirety by reference.

BACKGROUND OF THE INVENTION

1. Field of the Invention

The present invention relates to a liquid crystal display device, an image displaying method, and an image displaying program. More specifically, the present invention relates to a liquid crystal display device, an image displaying method, and an image displaying program, which can suppress deformations and after-images that are generated in moving images.

2. Description of the Related Art

A liquid crystal display (LCD) is a system for displaying moving pictures through switching the screen by each frame. However, unlike an impulse-type display device such as a CRT (cathode ray tube), the LCD is a hold-type display device where an image is held within a frame period. Thus, it has such shortcomings that blur, deformations and distortions of the image are generated in a moving video.

In the case of the impulse-type display device, an image is displayed as a pulse at the initial stage within a frame, which provides a black display until the next frame. Thus, the after-image recognized by the eyes of a user can be adjusted.

In the case of the hold-type display device, an image is held and displayed as a still picture within a frame period. Therefore, even though the eyes of the user follow a moving body smoothly from a frame to a next frame, the image being displayed stays still during the frame period and the frame shifts to the next continuously without a break. Therefore, the frame one before appears as an after-image to the user, so that the user perceives a double image where those shifted images are overlapped with each other. Thus, the user recognizes "blur". Such "blur" caused due to the eye-trace of the user in the hold-type display device will be described by referring to FIG. 12.

FIG. 12(1) shows a case where a dark-color line moves in a bright background, and FIG. 12(2) shows a case where a bright line moves in a dark background. FIG. 12(*b*) shows changes in time of one line that moves on a screen as in FIG. 12(*a*). The display system of a liquid crystal panel employs a hold-type drive, so that the same display is maintained within one frame period and the frame is shifted discontinuously. Meanwhile, the eyes of the user continuously follow a scroll of the screen as in "eye-trace" shown in FIG. 12(*b*). FIG. 12(*c*) shows the shift of the image in a coordinate system on the basis of eye-trace of the user.

On the basis of the eye-trace of the user, the image minutely oscillates by one-frame cycle. As shown in FIG. 12(*d*), the user recognizes a leveled luminance of the oscillations, thereby recognizing "blur".

In order to overcome such inconvenience, Japanese Unexamined Patent Publication 2002-23707 (Patent Document 1) discloses such contents that: one frame is divided into a plurality of sub-frames; an image based on an input luminance signal is displayed in a preceding sub-frame; and an image based on a signal that is obtained by dividing the input luminance signal by an attenuation coefficient is displayed in a following sub-frame.

A display device depicted in Patent Document 1 adjusts the after-image perceived by the eyes of the user through providing a period (where the image with the attenuated luminance is displayed) in one frame so as to decrease the "blur" that is caused due to the eye-trace of the user in the hold-type display device.

However, separately from the after-image perceived by the eyes of the user, the response speed of the liquid crystal has something to do with the "blur" that is a failure in expressing a moving picture in a liquid crystal display unit of a hold-type display device.

As can be seen from FIG. 12, regarding the "blur" caused due to the eye-trace of the user, the sizes of the "blur" recognized by the user are the same for the case where a dark-color line moves in a bright background and for the case where a bright line moves in a dark background.

The response speed of the liquid crystal panel differs between the time of applying a drive voltage and the time of discharging the voltage, due to a delay in the transition speed which is caused by the viscosity of the liquid crystal, a delay in starting the response which is caused by an overshoot drive, and the like. Also, the response speed differs depending on the transition of the gradations (from which gradation to which gradation), so the response of the liquid crystal becomes ununiform. Meanwhile, the blur generated in the moving picture caused due to the hold-type drive of the liquid crystal panel and the eye-trace of a human being is uniform and constant. Therefore, in the related art, the widths of the blur in the moving pictures differ depending on the image to be shifted, which provides a deformed and distorted image and generates a colored blur.

SUMMARY OF THE INVENTION

An exemplary object of the present invention is to provide a liquid crystal display device, an image displaying method, and an image displaying program, which can suppress distortions and color blur recognized by human beings in a moving image.

In order to achieve the foregoing exemplary object, a liquid crystal display device of the present invention includes: a liquid crystal panel with a plurality of pixels arranged in matrix; and a liquid crystal panel controlling device which controls a display state of the liquid crystal panel by applying a voltage to pixels in accordance with image signal inputted from an external apparatus, wherein the liquid crystal panel controlling device includes: a function of displaying a correction frame so as to reduce a response delay of the pixel between each of the frames that are displayed successively on the display panel in accordance with the inputted image signals; and a correction frame signal generating device which generates an image signal of the correction frame based on the image signals of the frames before and after the correction frame.

With such liquid crystal display device, it is possible to generate the correction frame (that works to reduce the delay of a pixel whose response has a lag when the frame is switched in the image display) based on the frames before and after the switching, and to display the image by inserting the correction frame between the previous and following frames.

As an exemplary advantage according to the invention, it is possible to make the blur uniform in a moving picture through overcoming the deformations and color blur generated in the moving image caused due to the ununiform responses of the liquid crystal panel.

DETAILED DESCRIPTION OF THE EXEMPLARY EMBODIMENTS

An exemplary embodiment of the present invention will be described by referring to the accompanying drawings.

Figure 1:
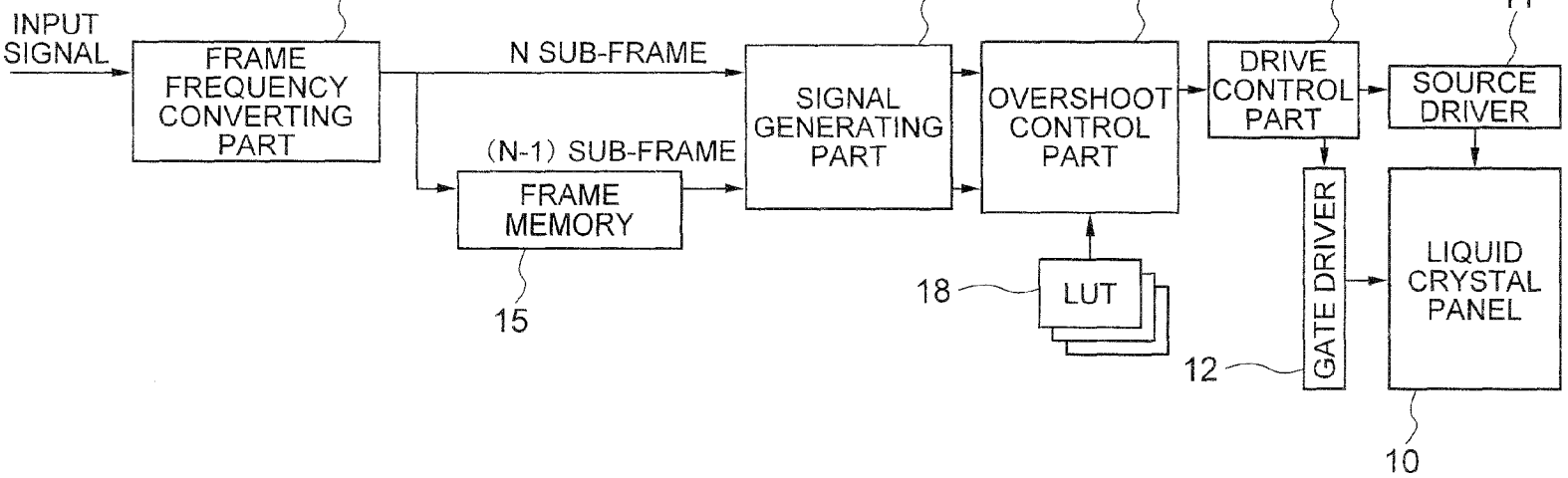
FIG. 1 is a block diagram for showing a structure of a liquid crystal display device according to an exemplary embodiment of the present invention.

FIG. 1 is a block diagram for showing a structure of a liquid crystal display device according to the exemplary embodiment.

The liquid crystal display device of the exemplary embodiment is a device which is connected to an external apparatus such as a personal computer, a DVD player, a television set, a VTR, or the like, and displays moving images including still pictures on a liquid crystal panel screen by reading image signals from the external apparatus.

As shown in FIG. 1, the liquid crystal display device of the exemplary embodiment includes: a liquid crystal panel 10 with a plurality of pixels arranged in matrix; a drive control part 13 as a liquid crystal panel controlling device for controlling the display state of the liquid crystal panel 10 based on image signals; a source driver 11; and a gate driver 12.

The liquid crystal display device of the exemplary embodiment is provided with: a frame frequency converting part 14 which converts an image signal that is inputted from the outside into a double-frame frequency and outputs the double-frame frequency; and a frame memory 15 and a signal generating part 16, which function as a correction frame signal generating device to generate a correction frame image signal in accordance with image signals of the previous and following frames that are outputted successively from the frame frequency converting part 14.

The frame memory 15 temporarily stores information for one frame of the image signals that are outputted successively from the frame frequency converting part 14. The signal generating part 16 inputs an image signal of one frame out of the image signals outputted successively from the frame frequency converting part 14, while reading out an image signal of the frame that is one before that one frame from the frame memory 15 to generate an image signal of a correction frame.

The liquid crystal display device of the exemplary embodiment is provided with: an overshoot control part 17 which converts the image signal such that an overshoot voltage (that is an excessive signal voltage than a gradation voltage of a pixel that is defined by an input signal) is applied to the pixel; and a lookup table (LUT) 18 in which the overshoot voltages that are to be applied to the pixels are stored by being related to various cases.

The overshoot control part 17: inputs an image signal that is to be supplied to the drive control part 13 from the signal generating part 16, while reading out an image signal from the frame memory 15; specifies the overshoot voltage that corresponds to the signals of the two pixels by referring to the lookup table 18 regarding the pixel information for each of the image signals; and corrects the image signal from the signal generating part 16 to apply the overshoot voltage and outputs it to the drive control part 13.

It is noted here that the functional contents of the overshoot control part 17 may be put into a program to be executed by a computer as overshoot control processing.

The liquid crystal panel 10 shown in FIG. 1 includes: a plurality of source bus lines that are arranged in parallel with each other in a longitudinal direction of a screen; and a plurality of scanning lines that are arranged in parallel with each other in a lateral direction of the screen. The source bus lines are connected to the source driver 11, and the scanning lines are connected to the gate driver 12. The source bus lines and the scanning lines are orthogonal to each other, and pixels are formed by corresponding to the intersection points thereof. TFTs (Thin Film Transistors) are disposed at the pixels.

When displaying an image on the liquid crystal panel 10, the gate driver 12 successively turns ON the TFTs by each scanning line, and the source driver 11 applies a gradation voltage to a specific pixel on the scanning line via the source bus line at the timing where the TFT is ON.

The source driver 11 and the gate driver 12 are controlled by the drive control part 13. The drive control part 13 transmits a scanning signal indicating a scanning timing to the gate driver 12, and transmits a gradation signal for applying a gradation voltage that corresponds to each pixel by synchronizing with the scanning timing to the source driver 11.

The frame frequency converting part 14 shown in FIG. 1 has a function of inputting an image signal from the outside, and converts an image signal to a double frequency to be outputted every time the image signal for one frame is inputted. The frame frequency converting part 14 outputs the image signal with a double frequency while inputting the image signal for one frame, so that it outputs the image signal in a half-frame period. Thereafter, no signal is outputted for a half-frame period. The image signals outputted intermittently from the frame frequency converting part 14 in the manner described above are inputted to the frame memory 15 and the signal generating part 16.

The frame memory 15 inputs the image signal of one frame from the frame frequency converting part 14 and stores the information of that frame. At the same time, the frame memory 15, upon receiving an input of an image signal of a next frame from the frame frequency converting part 14, rewrites the stored information and stores the information of the next frame. Like this, the frame memory 15 has a storage capacity for storing the image signal for one frame.

Among the image signals from the frame frequency converting part 14, the signal generating part 16 compares the pixel data of the frames before and after the correction frame that is to be generated, and selects and sets, for each pixel, one of the gradation levels thereof, which is suitable for decreasing the response delay of the pixel, to generate the image signal of the correction frame.

The signal generating part 16 inputs the image signal of one frame from the frame frequency converting part 14. At the same time, the signal generating part 16 reads out the image signal of the previous frame (the frame one before) from the frame memory 15, compares that image signal with the inputted image signal, and generates and outputs the image signal of the correction frame based on the pixel gradation levels defined by those image signals. The signal generating part 16 reads out and outputs the image signal for one frame which is stored in the frame memory 15, during a period where there is no image signal inputted from the frame frequency converting part 14.

The image signal outputted from the signal generating part 16 is inputted to the drive control part 13, and signal-processed by the drive control part 13. A gradation signal obtained thereby is transmitted to the source driver 11, and a scanning signal is transmitted to the gate driver 12. As a result, the correction frame is displayed between each of the frames of the image signals inputted from the outside. Thereby, the positions of blur in the displayed image can be adjusted.

It is noted here that the functional contents of the above-described frame frequency converting part 14 may be put into a program to be executed by a computer as image signal input processing and frame frequency conversion processing. Further, the functional contents of the signal generating part 16 and the drive control part 13 described above may also be put into programs to be executed as correction frame signal generating processing and image display processing.

Figures 2A, 2B:
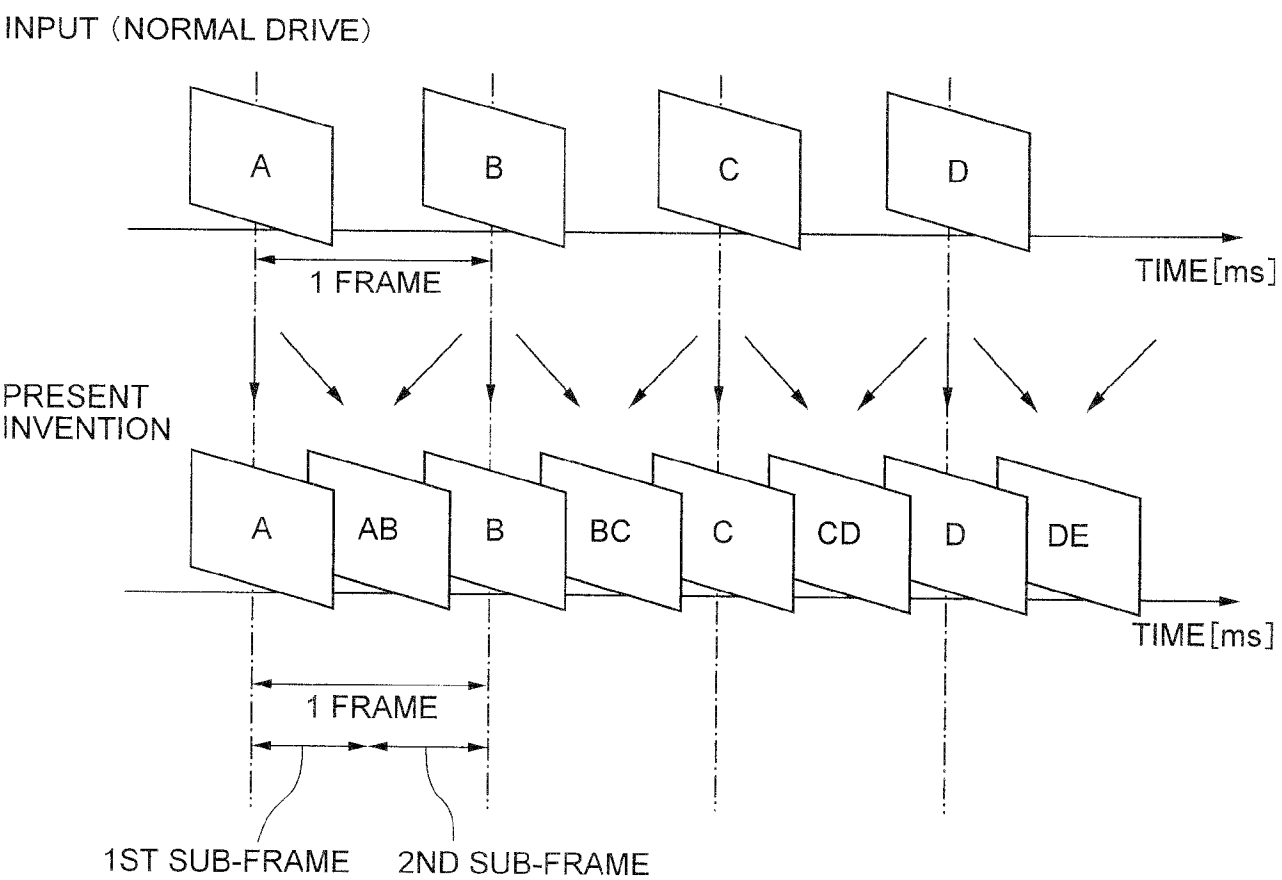
FIGS. 2A and 2B show illustrations for describing a moving image display of the liquid crystal display device according to the exemplary embodiment shown in FIG. 1.

As shown in FIGS. 2A and 2B, in the liquid crystal display device of the exemplary embodiment configured in this way, one frame period of the case where the input image signal from the outside is driven as it is (FIG. 2A) is divided into halves to a first sub-frame and a second sub-frame. A screen A based on the input image signal is displayed on the first sub-frame, and a screen AB based on the screen A and a screen B is displayed on the second sub-frame (FIG. 2B).

(Case of Normal Drive)

Figure 3:
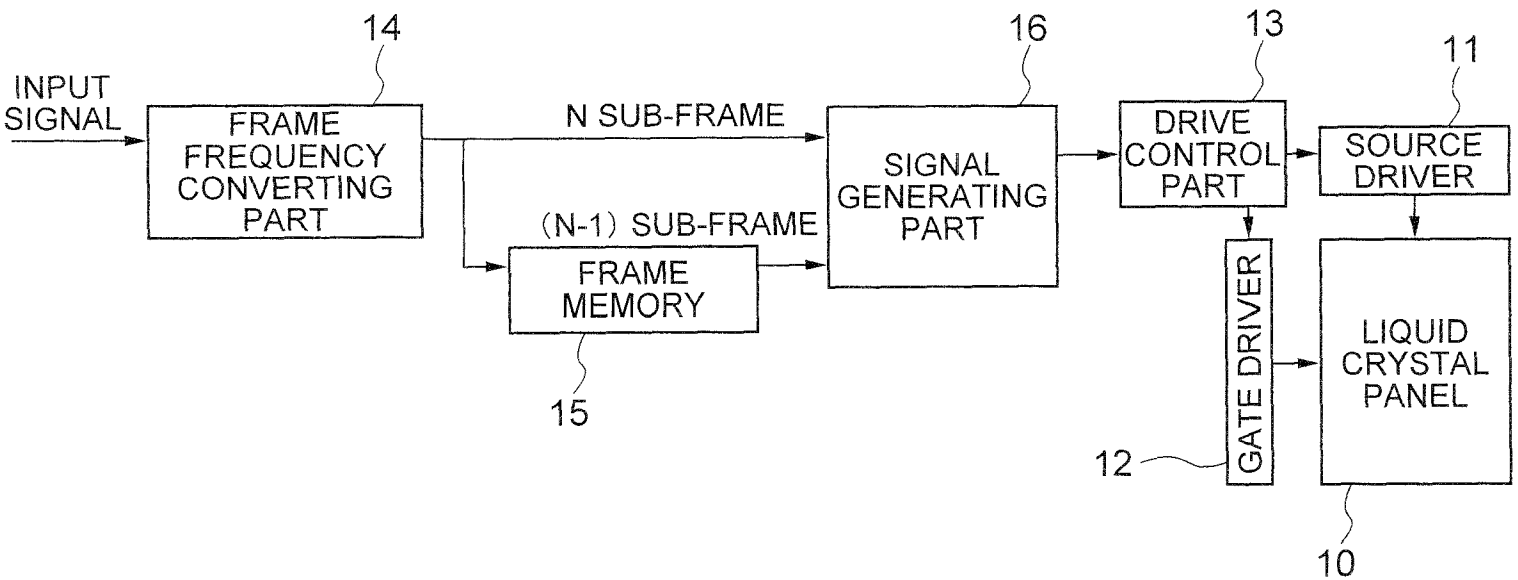
FIG. 3 is a block diagram for showing another example of the structure of the liquid crystal display device according to the exemplary embodiment shown in FIG. 1.

Now, the liquid crystal display device of the exemplary embodiment, which has neither the over shoot control part 17 nor the LUT 18, will be described. FIG. 3 is a block diagram for showing the structure of the liquid crystal display device of such case.

In general, the response speed of the liquid crystal is determined based on the applied voltage and the viscosity of the liquid crystal when the voltage is being applied, while it is determined based only on the viscosity of the liquid crystal under the discharge state. Therefore, the response speed becomes slower in the voltage discharge state than in the voltage applied state.

Based on this, the exemplary embodiment will be described regarding a case where the pixel display mode of the liquid crystal panel 10 is normally-white where the display is in white when a voltage is not applied, and a case of normally-black where the display is in black when a voltage is not applied.

(Case of Normally-White)

Figure 4A:
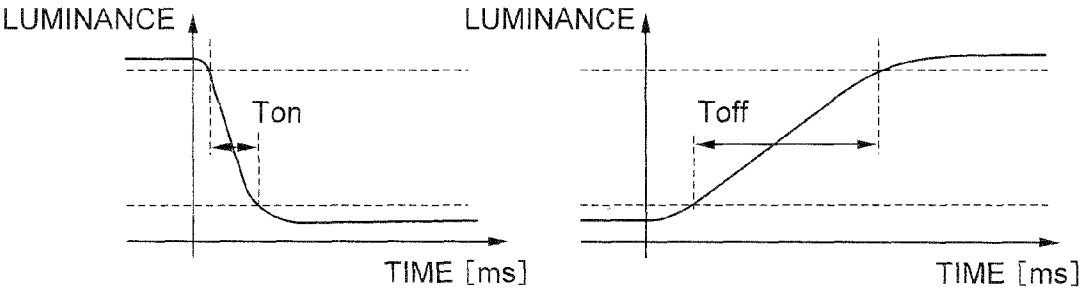
FIGS. 4A and 4B show illustrations for describing characteristics of a liquid crystal panel according to the exemplary embodiment shown in FIG. 1.

When the pixel display mode of the liquid crystal panel 10 is normally-white, there is a delay in the time of discharging the voltage to the pixel (that is, the time where the pixel display changes from dark to bright), as shown in FIG. 4A.

Figure 5:
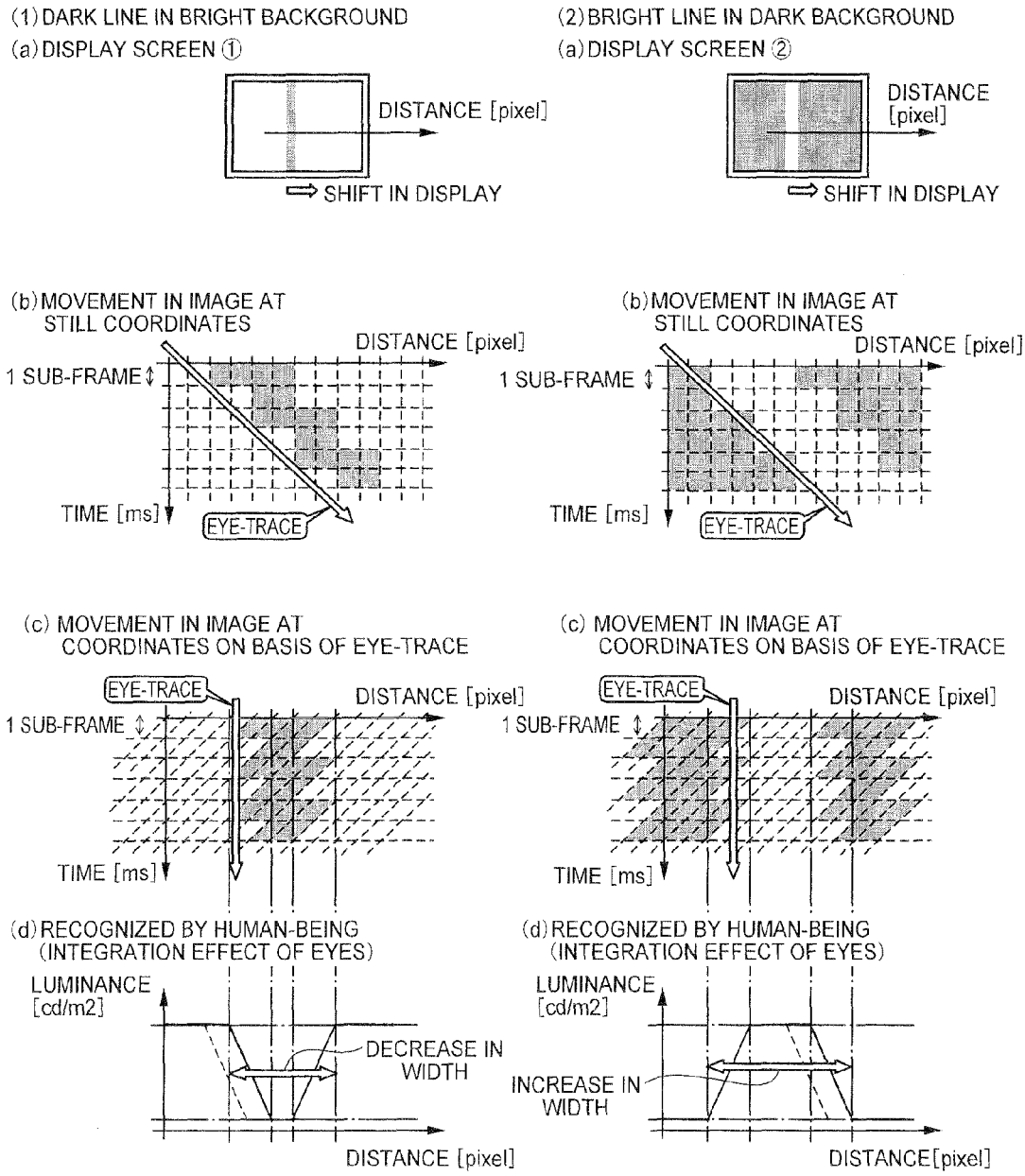
FIG. 5 shows illustrations for describing an example of the moving image display of the liquid crystal display device according to the exemplary embodiment shown in FIG. 1.

Therefore, a correction frame that is formed by taking the pixel with a larger gradation level out of the previous and following frames is inserted between the previous and following frames. With this, as shown in FIG. 5, the time for switching from the dark to bright becomes faster, which changes the size of the blur in the moving picture recognized by the user. Thus, the blur is recognized with a reduced line width when a dark-colored line moves in a bright background as in FIG. 5(1) and with an increased line width when a bright line moves in a dark background as in FIG. 5(2).

Figure 6:
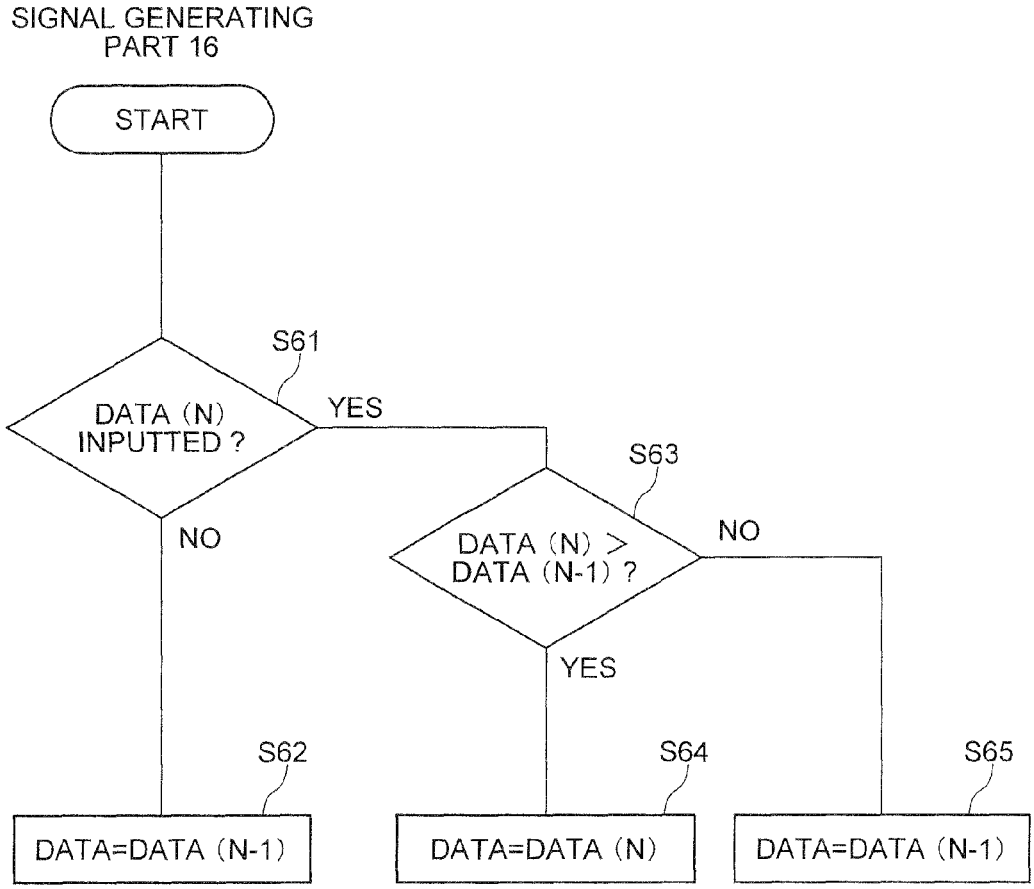
FIG. 6 is a flowchart for showing actions of a signal generating part according to the exemplary embodiment shown in FIG. 1.

Actions of the liquid crystal display device according to the exemplary embodiment in such case will be described. FIG. 6 is a flowchart for showing the actions of the signal generating part 16 of the exemplary embodiment. The actions below is an exemplary embodiment of a medium judging method, so that it will be explained along the actions that correspond to each step of the medium judging method.

First, the frame frequency converting part 14 inputs image signals from the outside, converts the image signal to a double frame frequency every time the image signal for one frame is inputted, and outputs the double frame frequency (a frame frequency converting step). The outputted image signals are inputted to the frame memory 15 and the signal generating part 16, and information for one frame is stored temporarily to the frame memory 15.

Then, the signal generating part 16 judges whether or not there is an input of an image signal from the frame frequency converting part 14 (FIG. 6: step S61). When there is an input of an image signal, the signal generating part 16 reads out an image signal from the frame memory 15, compares the image signal of one frame inputted from the frame frequency converting part 14 and the image signal of the previous frame (the frame one before) which is read out from the frame memory 15 to judge whether or not the pixel gradation level of that one frame takes a value larger than that of the frame one before (FIG. 6: step S63) If the value is larger, the gradation level for that pixel is set as same as the value of that one frame (FIG. 6: step S64), while the gradation level for that pixel is set as same as the value of the frame one before, if the value is not larger (FIG. 6: step S65). This selection of the pixel gradation is performed for all the pixels (a correction frame signal generating step), and the image signal where all the pixel gradations are specified is outputted as the signal of the correction frame.

When there is no input of the image signal from the frame frequency converting part 14, the signal generating part 16 inputs an image signal from the frame memory 15 and outputs it (FIG. 6: step S62).

The signals outputted from the signal generating part 16 are outputted in order from the image signal of the frame one before, the correction frame signal, and the image signal of the single frame. Thus, the drive control part 13 inputs those signals in order from the image signal of the frame one before, the correction frame signal, and the image signal of the single frame. With this, displayed on the liquid crystal panel 10 is a moving image where the correction frame is inserted between that one frame and the frame one before (a display step).

As described, in the case where the pixel display mode of the liquid crystal panel 10 is normally-white in the exemplary embodiment, regarding the gradation levels of each pixel in the screen AB shown in FIG. 2, the larger gradation level (that is, the pixel gradation levels of the screen B) is set for the pixels whose gradations become larger when the screen is switched from the screen A to the screen B, and the gradation level of the screen A is set for other pixels. Through inserting such screen AB between the screens A and B, it is possible to decrease the ununiformity in the response speed of the pixels at the time of switching the screen from the screen A to the screen B.

Figure 7:
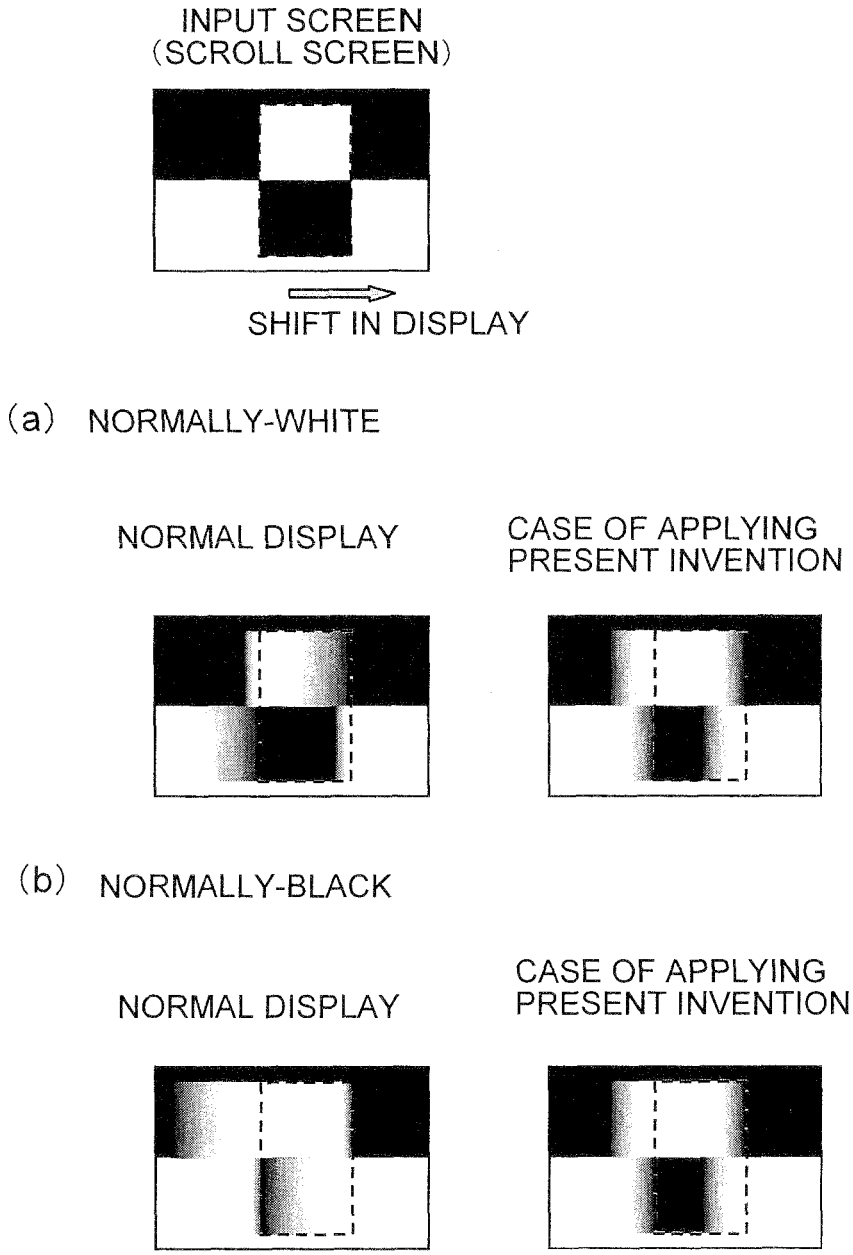
FIGS. 7(*a*) and 7(*b*) show illustrations for describing an example of the moving image display of the liquid crystal display device according to the exemplary embodiment shown in FIG. 1.

With this, as shown in FIG. 7(*a*), it is possible in the moving picture display of the exemplary embodiment to decrease deformations of the image compared to the normal moving picture display where the blur at the dark part becomes conspicuous because of a delay in switching the display from dark to bright.

(Case of Normally-Black)

Figure 4B:
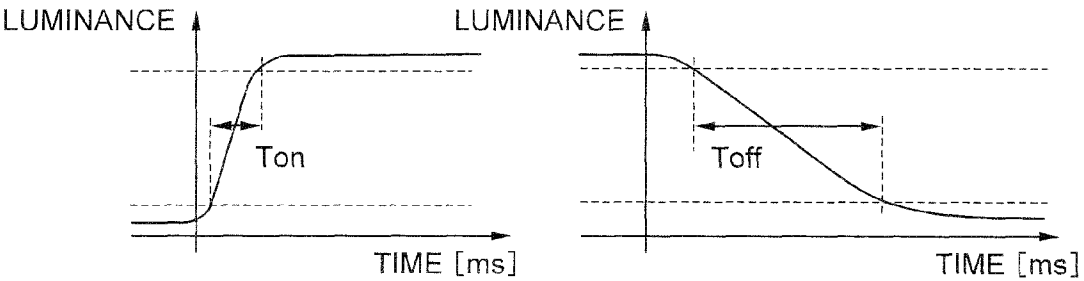

When the pixel display mode of the liquid crystal panel 10 is normally-black, there is a delay in the time of discharging the voltage to the pixel (that is, the time where the pixel display changes from bright to dark), as shown in FIG. 4B.

Figure 8:
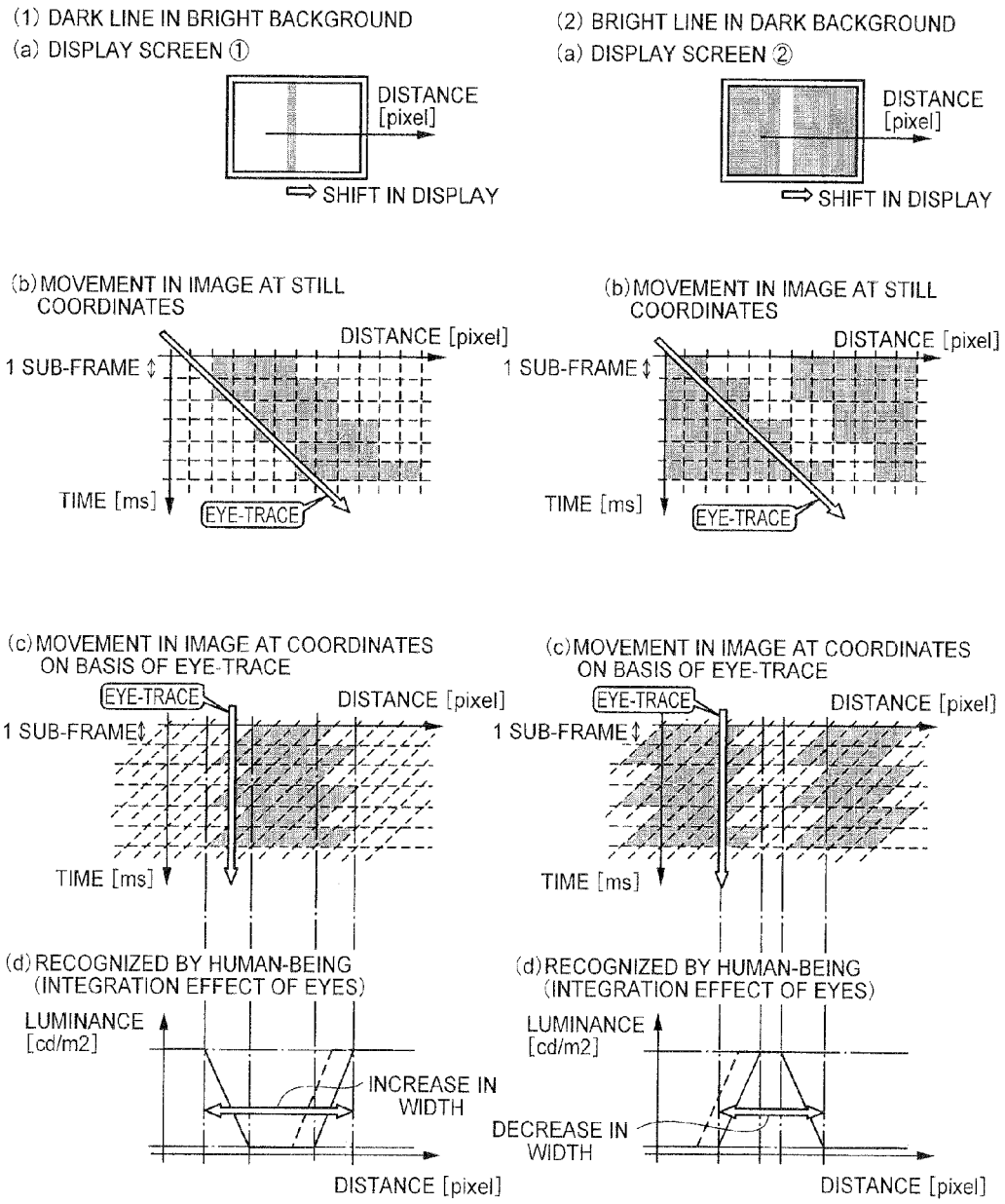
FIG. 8 shows illustrations for describing another example of the moving image display of the liquid crystal display device according to the exemplary embodiment shown in FIG. 1.

Therefore, the correction frame that is formed by taking the pixel with a smaller gradation level out of the previous and following frames is inserted between the previous and following frames. With this, as shown in FIG. 8, the time for switching from bright to dark becomes faster, which changes the size of the blur in the moving picture recognized by the user. Thus, the blur is recognized with an increased line width when a dark-colored line moves in a bright background as in FIG. 8(1) and with a reduced line width when a bright line moves in a dark background as in FIG. 8(2).

Figure 9:
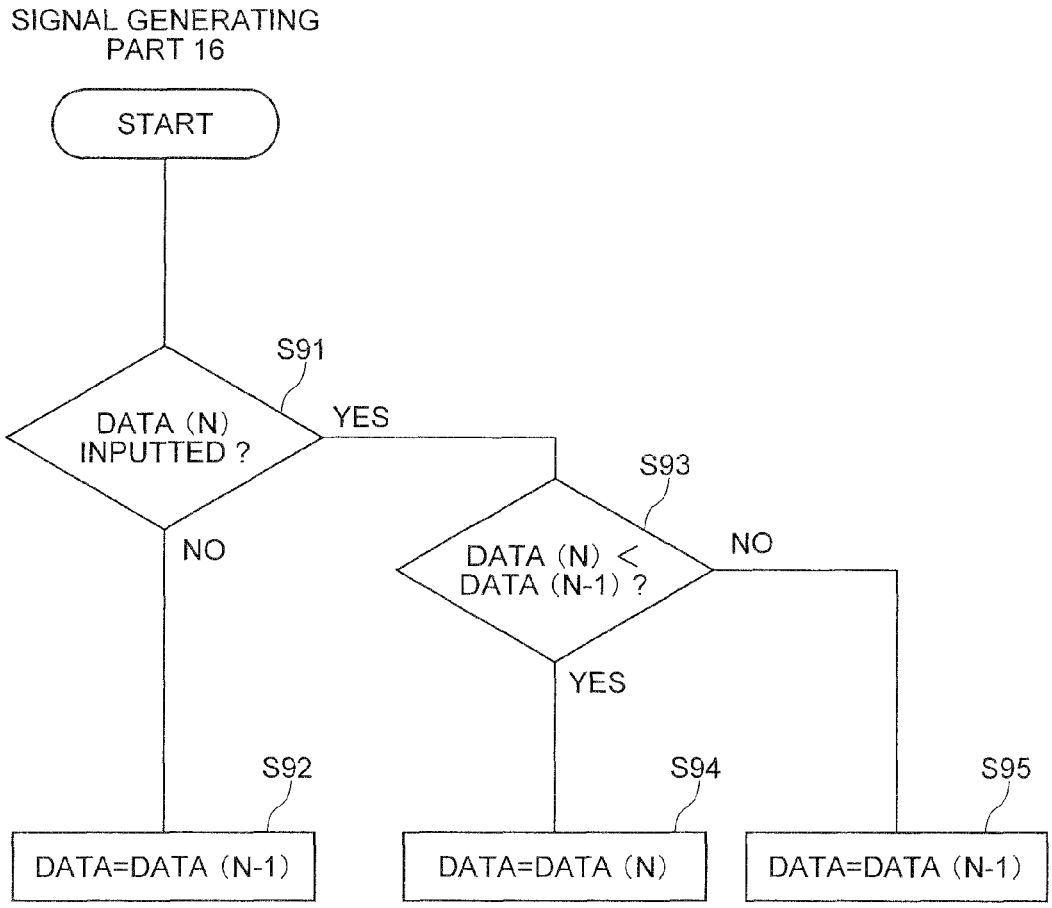
FIG. 9 is a flowchart for showing actions of the signal generating part according to the exemplary embodiment shown in FIG. 1.

Actions of the liquid crystal display device according to the exemplary embodiment in such case will be described. FIG. 9 is a flowchart for showing the actions of the signal generating part 16 of the exemplary embodiment. The actions below is an exemplary embodiment of a medium judging method, so that it will be explained along the actions that correspond to each step of the medium judging method.

First, the frame frequency converting part 14 inputs image signals from the outside, converts the image signal to a double frame frequency every time the image signal for one frame is inputted, and outputs the double frame frequency (a frame frequency converting step). The outputted image signals are inputted to the frame memory 15 and the signal generating part 16, and information for one frame is stored temporarily to the frame memory 15.

Then, the signal generating part 16 judges whether or not there is an input of an image signal from the frame frequency converting part 14 (FIG. 9: step S91). When there is an input of an image signal, the signal generating part 16 reads out an image signal from the frame memory 15, compares the image signal of one frame inputted from the frame frequency converting part 14 and the image signal of the previous frame (the frame one before) which is read out from the frame memory 15 to judge whether or not the pixel gradation level of that one frame takes a value smaller than that of the frame one before (FIG. 9: step S93). If the value is smaller, the gradation level for that pixel is set as same as the value of that one frame (FIG. 9: step S94), while the gradation level for that pixel is set as same as the value of the frame one before, if the value is not smaller (FIG. 9: step S95). This selection of the pixel gradation is performed for all the pixels (a correction frame signal generating step), and the image signal where all the pixel gradations are specified is outputted as the image signal of the correction frame.

When there is no input of the image signal from the frame frequency converting part 14, the signal generating part 16 inputs an image signal from the frame memory 15 and outputs it (FIG. 9: step S92).

The image signals outputted from the signal generating part 16 are outputted in order from the image signal of the frame one before, the correction frame signal, and the image signal of the single frame. Thus, the drive control part 13 inputs those signals in order from the image signal of the frame one before, the correction frame signal, and the image signal of the single frame. With this, displayed on the liquid crystal panel 10 is a moving image where the correction frame is inserted between that one frame and the frame one before (a display step).

As described, in the case where the pixel display mode of the liquid crystal panel 10 is normally-black in the exemplary embodiment, regarding the gradation levels of each pixel in the screen AB shown in FIG. 2, the smaller gradation level (that is, the pixel gradation levels of the screen B) is set for the pixels whose gradations become smaller when the screen is switched from the screen A to the screen B, and the gradation level of the screen A is set for other pixels. Through inserting such screen AB between the screens A and B, it is possible to decrease the ununiformity in the response speed of the pixels at the time of switching the screen from the screen A to the screen B.

With this, as shown in FIG. 7(*b*), it is possible in the moving picture display of the exemplary embodiment to decrease deformations of the image compared to the normal moving picture display where the blur at the bright part becomes conspicuous.

As described above, the liquid crystal display device of the exemplary embodiment is configured to display the images by decreasing the ununiformity in the response speed of the liquid crystal panel 10, thereby making it possible to have the sizes of the "blur" uniform in the displayed moving images.

(Case of Overshoot Drive)

Next, the liquid crystal display device of the exemplary embodiment which has the overshoot control part 17 and the LUT 18 will be described. FIG. 1 is a block diagram for showing the structure of such case.

A VA(Vertical Alignment)-type liquid crystal and a TN(Twisted Nematic)-type liquid crystal have such a characteristic that there is a large delay in starting the change in the transmittance with respect to the time of applying a voltage, when the applied voltage is changed from a small voltage to a large voltage. Therefore, even when the speed of the response is set to fall within one frame by executing an overshoot drive, transitions in the response of the liquid crystal differ for the time of discharging the voltage and for the time of applying the voltage.

Based on this, the exemplary embodiment will be described regarding a case where the liquid crystal panel 10 is the VA type and a case where the liquid crystal panel 10 is the TN type.

(Case of VA-Type Liquid Crystal Panel)

Figure 10A:
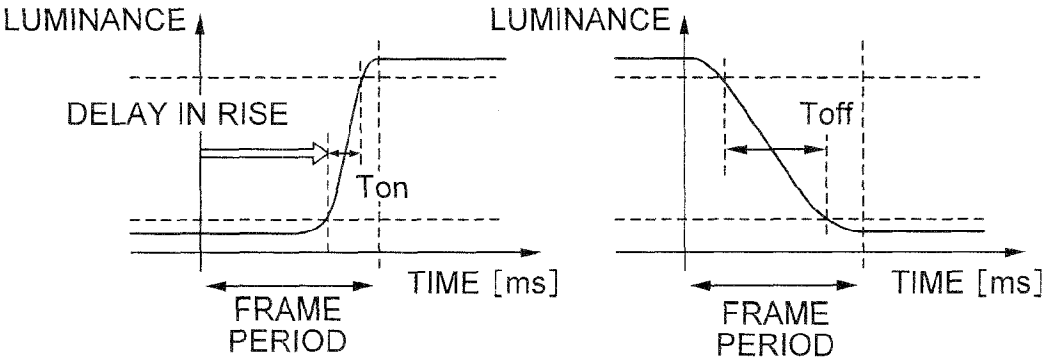
FIGS. 10A and 10B show illustrations for describing characteristics of the liquid crystal panel according to the exemplary embodiment shown in FIG. 1.

In the case where the liquid crystal panel 10 is a VA-type liquid crystal panel, there is a delay in a rise when the pixel display is switched from dark to bright at the time of applying a voltage to the pixels, as shown in FIG. 10A.

Therefore, the correction frame that is formed by taking the pixel with a larger gradation level out of the previous and following frames is inserted between the previous and following frames. With this, as shown in FIG. 5, the time for switching from dark to bright becomes faster, which changes the size of the blur in the moving picture recognized by the user. Thus, the blur is recognized with a reduced line width when a dark-colored line moves in a bright background as in FIG. 5(1) and with an increased line width when a bright line moves in a dark background as in FIG. 5(2).

Actions of the liquid crystal display device according to the exemplary embodiment in such case will be described. FIG. 6 is a flowchart for showing the actions of the signal generating part 16 of the exemplary embodiment. The actions below is an exemplary embodiment of a medium judging method, so that it will be explained along the actions that correspond to each step of the medium judging method.

First, the frame frequency converting part 14 inputs image signals from the outside, converts the image signal to a double frame frequency every time the image signal for one frame is inputted, and outputs the double frame frequency (a frame frequency converting step). The outputted image signals are inputted to the frame memory 15 and the signal generating part 16, and information for one frame is stored temporarily to the frame memory 15.

Then, the signal generating part 16 judges whether or not there is an input of an image signal from the frame frequency converting part 14 (FIG. 6: step S61). When there is an input of an image signal, the signal generating part 16 reads out an image signal from the frame memory 15, compares the image signal of one frame inputted from the frame frequency converting part 14 and the image signal of the previous frame (the frame one before) which is read out from the frame memory 15 to judge whether or not the pixel gradation level of that one frame takes a value larger than that of the frame one before (FIG. 6: step S63). If the value is larger, the gradation level for that pixel is set as same as the value of that one frame (FIG. 6: step S64), while the gradation level for that pixel is set as same as the value of the frame one before, if the value is not larger (FIG. 6: step S65). This selection of the pixel gradation is performed for all the pixels (a correction frame signal generating step), and the image signal where all the pixel gradations are specified is outputted as the signal of the correction frame.

When there is no input of the image signal from the frame frequency converting part 14, the signal generating part 16 inputs an image signal from the frame memory 15 and outputs it (FIG. 6: step S62).

The signals outputted from the signal generating part 16 are outputted in order from the image signal of the frame one before, the correction frame signal, and the image signal of the single frame, which are then corrected by the overshoot control part 17 and outputted in order (an overshoot control step). Thus, the drive control part 13 inputs those signals in order from the image signal of the frame one before, the correction frame signal, and the image signal of the single frame. With this, the correction frame is displayed before the single frame on the liquid crystal panel 10 (a display step).

As described, in the exemplary embodiment, when the liquid crystal panel 10 is the VA-type liquid crystal panel and an overshoot drive is executed, regarding the gradation levels of each pixel in the screen AB shown in FIG. 2, the larger gradation level (that is, the pixel gradation levels of the screen B) is set for the pixels whose gradations become larger when the screen is switched from the screen A to the screen B, and the gradation level of the screen A is set for other pixels. Through inserting such screen AB between the screens A and B, it is possible to decrease the ununiformity in the response speed of the pixels at the time of switching the screen from the screen A to the screen B.

Figure 11:
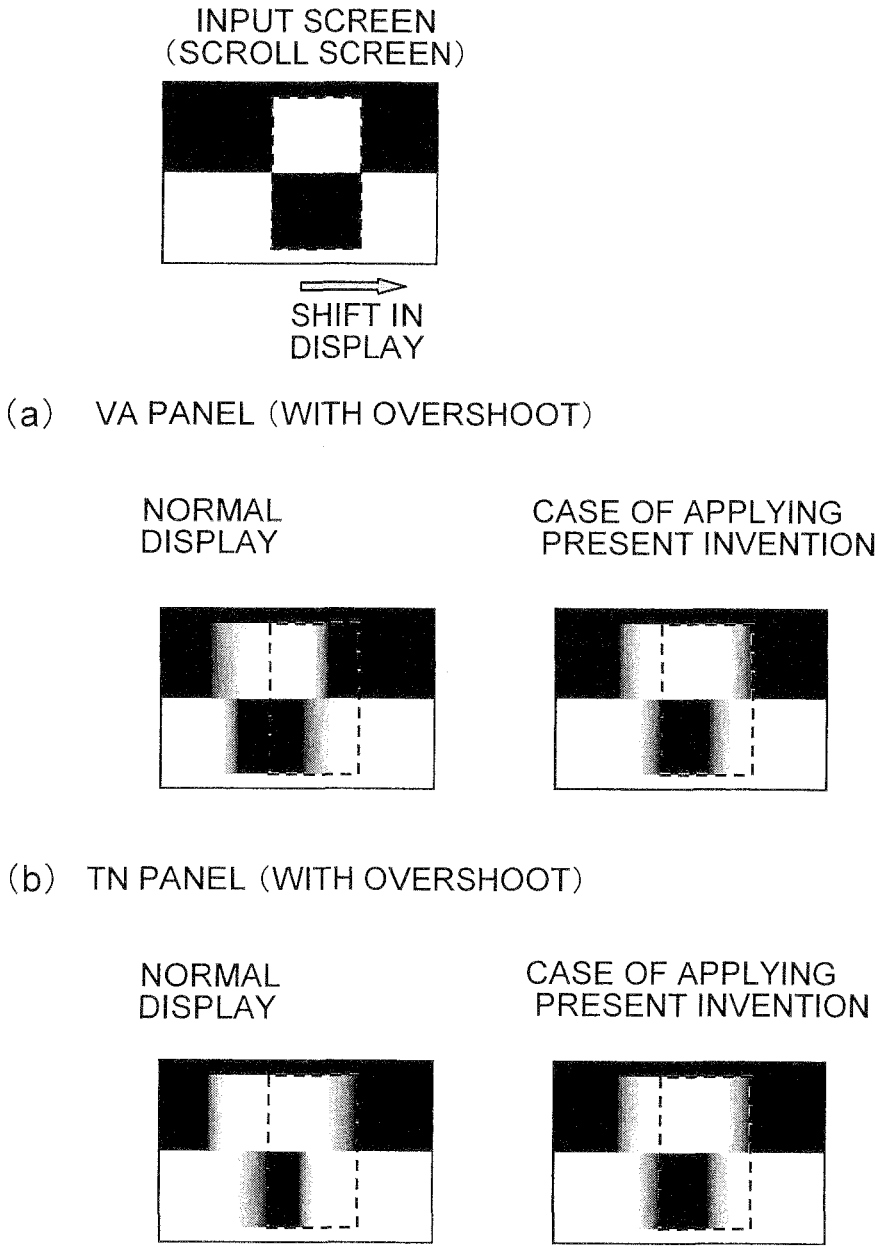
FIGS. 11(*a*) and 11(*b*) show illustrations for describing an example of the moving image display of the liquid crystal display device according to the exemplary embodiment shown in FIG. 1.
Figure 12:
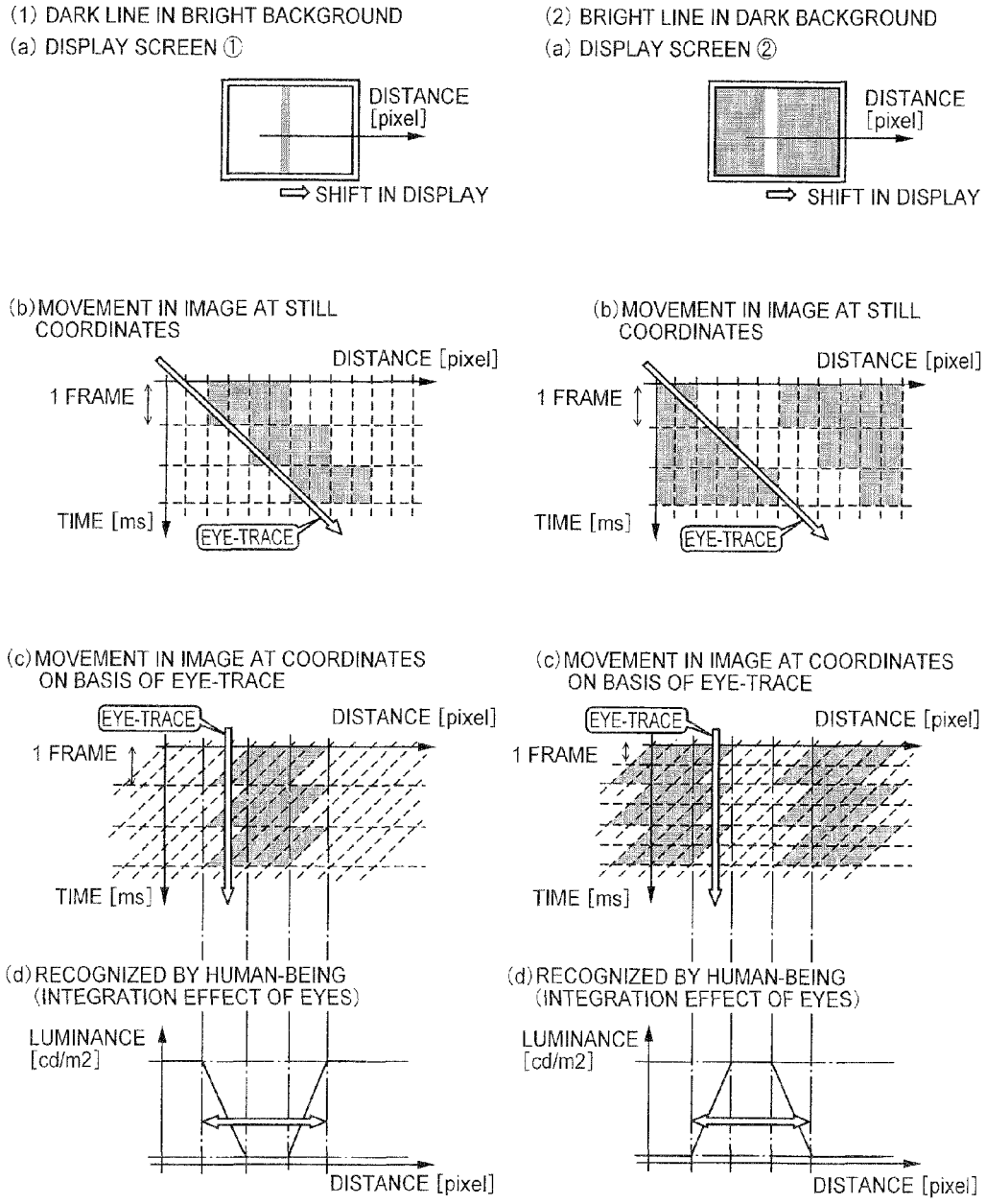
FIG. 12 shows illustrations for describing an example of a moving image display of a conventional liquid crystal display device.

With this, as shown in FIG. 11(*a*), it is possible in the moving picture display of the exemplary embodiment to decrease deformations of the image compared to the normal moving picture display where the blur at the dark part becomes conspicuous because of a delay in switching the display from dark to bright.

(Case of TN-Type Liquid Crystal Panel)

Figure 10B:
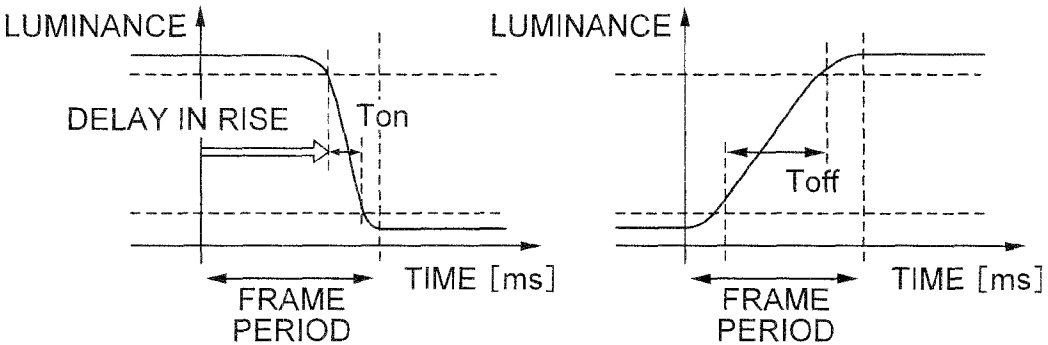

In the case where the liquid crystal panel 10 is a TN-type liquid crystal panel, there is a delay in a rise when the pixel display is switched from bright to dark (that is, at the time of applying a voltage to the pixels) as shown in FIG. 10B.

Therefore, the correction frame that is formed by taking the pixel with a smaller gradation level out of the previous and following frames is inserted between the previous and following frames. As shown in FIG. 8, the time for switching from bright to dark becomes faster, which changes the size of the blur in the moving picture recognized by the user. Thus, the blur is recognized with an increased line width when a dark-colored line moves in a bright background as in FIG. 8(1) and with a reduced line width when a bright line moves in a dark background as in FIG. 8(2).

Actions of the liquid crystal display device according to the exemplary embodiment in such case will be described. FIG. 9 is a flowchart for showing the actions of the signal generating part 16 of the exemplary embodiment. The actions below is an exemplary embodiment of a medium judging method, so that it will be explained along the actions that correspond to each step of the medium judging method.

First, the frame frequency converting part 14 inputs image signals from the outside, converts the image signal to a double frame frequency every time the image signal for one frame is inputted, and outputs the double frame frequency (a frame frequency converting step). The outputted image signals are inputted to the frame memory 15 and the signal generating part 16, and information for one frame is stored temporarily to the frame memory 15.

Then, the signal generating part 16 judges whether or not there is an input of an image signal from the frame frequency converting part 14 (FIG. 9: step S91). When there is an input of an image signal, the signal generating part 16 reads out an image signal from the frame memory 15, compares the image signal of one frame inputted from the frame frequency converting part 14 and the image signal of the previous frame (the frame one before) which is read out from the frame memory 15 to judge whether or not the pixel gradation level of that one frame takes a value smaller than that of the frame one before (FIG. 9: step S93). If the value is smaller, the gradation level for that pixel is set as same as the value of that one frame (FIG. 9: step S94), while the gradation level for that pixel is set as same as the value of the frame one before, if the value is not larger (FIG. 9: step S95). This selection of the pixel gradation is performed for all the pixels (a correction frame signal generating step), and the image signal where all the pixel gradations are specified is outputted as the signal of the correction frame.

When there is no input of the image signal from the frame frequency converting part 14, the signal generating part 16 inputs an image signal from the frame memory 15 and outputs it (FIG. 9: step S92).

The signals outputted from the signal generating part 16 are outputted in order from the image signal of the frame one before, the correction frame signal, and the image signal of the single frame, which are then corrected by the overshoot control part 17 and outputted in order (an overshoot control step). Thus, the drive control part 13 inputs those signals in order from the image signal of the frame one before, the correction frame signal, and the image signal of the single frame. With this, the correction frame is displayed before the single frame on the liquid crystal panel 10 (a display step).

As described, in the exemplary embodiment, when the liquid crystal panel 10 is the TN-type liquid crystal panel and an overshoot drive is executed, regarding the gradation levels of each pixel in the screen AB shown in FIG. 2, the smaller gradation level (that is, the pixel gradation levels of the screen B) is set for the pixels whose gradations become smaller when the screen is switched from the screen A to the screen B, and the gradation level of the screen A is set for other pixels. Through inserting such screen AB between the screens A and B, it is possible to decrease the ununiformity in the response speed of the pixels at the time of switching the screen from the screen A to the screen B.

With this, as shown in FIG. 11(*b*), it is possible in the moving picture display of the exemplary embodiment to decrease deformations of the image compared to the normal moving picture display where the blur at the bright part becomes conspicuous.

As described above, the liquid crystal display device of the exemplary embodiment is configured to display the images by decreasing the ununiformity in the response speed of the liquid crystal panel 10, which is generated at the time of executing the overshoot drive, thereby making it possible to have the sizes of the "blur" uniform in the displayed moving images.

In the exemplary embodiment, the frame frequency converting part 14 converts the frame frequency of the image signals that are inputted from the outside into a double frequency, and outputs the double frequency. However, it is not limited to such case. The frame frequency converting part 14 may multiplies the frame frequency of the image signals that are inputted from the outside by n (n>1) to be outputted. In this case, the frame period becomes 1/n, so that the correction frame may be displayed within 1-1/n frame period.

For example, the signal generating part 16 may generate a correction frame signal with the frame frequency that is n/(n−1) times the frame frequency that is defined by the inputted image signal. Alternatively, the frame frequency converting part 14 may repeatedly output the signal whose frame frequency is multiplied by n (n>1) for n−1 times, and the signal generating part 16 may generate the correction frame signal with the frame frequency that is n (n>1) times the frame frequency defined by the input image signal. With such structure, it is possible to insert the correction frame that corrects the delay in the response of the pixels between the frames while maintaining the frame rate of the inputted image signals.

As described above, the liquid crystal display device of the exemplary embodiment is capable of displaying the correction frame (that works to reduce the delay of the response at the pixels for changing to the target gradation at the time of switching the display frames) between the frames, so that the sizes of "blur" in the displayed moving image can be made uniform. Through this, deformations and discolorations of the moving image recognized by the user can be decreased.

Further, in the above-described liquid crystal display device, the correction frame signal generating device described above: compares the pixel gradation levels defined by the image signals of the previous and following frames of the correction frame to be generated; and selects and sets, for each pixel, the gradation level (among the gradation levels thereof) that is suited for reducing the response delay of the pixel to generate the image signal of the correction frame.

With this, it becomes possible to display the correction frame (that works to reduce the delay of the response at the pixels for changing to the target gradation at the time of switching the display frames) between the frames.

Further, in the above-described liquid crystal display device, the correction frame signal generating device temporarily stores information for one frame of the inputted image signals that are inputted successively by each frame in the frame memory, and generates the image signal of the correction frame based on the image signal of that one frame among the inputted image signals and the image signal of the frame that is one before that one frame, which is stored in the frame memory.

With this, it is possible to compare the image signals of that one frame and the frame one before, and to generate the image signal of the correction frame based thereupon.

Further, the above-described liquid crystal display device includes a frame frequency converting part which converts the frame frequency of the image signal to that of n (n>1) times.

With this, the frame period becomes 1/n, and it becomes possible to insert the correction frame between the frames while maintaining the frame rate of the inputted image signals.

Furthermore, in a case where the pixel display mode of the liquid crystal panel in the above-described liquid crystal display device is normally-white, the correction frame signal generating device selects a larger gradation level for the pixels whose gradation levels of the image signals in the previous and following frames of the correction frame to be generated are different, while selecting the same gradation level for the pixels whose gradation levels are the same, and sets the gradation levels of each pixel to the selected levels so as to generate the image signal of the correction frame.

This makes it possible to decrease the ununiformity of the pixel response caused due to the delay in the transition speed because of the viscosity of the liquid crystal.

Moreover, in a case where the pixel display mode of the liquid crystal panel in the above-described liquid crystal display device is normally-black, the correction frame signal generating device selects a smaller gradation level for the pixels whose gradation levels of the image signals in the previous and following frames of the correction frame to be generated are different, while selecting the same gradation level for the pixels whose gradation levels are the same, and sets the gradation levels of each pixel to the selected levels so as to generate the image signal of the correction frame.

This makes it possible to decrease the ununiformity of the pixel response caused due to the delay in the transition speed because of the viscosity of the liquid crystal.

Further, the above-described liquid crystal display device includes a VA-type liquid crystal panel and an overshoot control part which corrects the image signal so that the liquid crystal panel executes an overshoot drive, wherein, under the overshoot drive, the correction frame signal generating device selects a larger gradation level for the pixels whose gradation levels of the image signals in the previous and following frames of the correction frame to be generated are different, while selecting the same gradation level for the pixels whose gradation levels are the same, and sets the gradation levels of each pixel to the selected levels so as to generate the image signal of the correction frame.

This makes it possible to decrease the ununiformity of the pixel response caused due to a delay in starting the response of the liquid crystal because of the overshoot drive.

Further, the above-described liquid crystal display device includes a TN-type liquid crystal panel and an overshoot control part which corrects the image signal so that the liquid crystal panel executes an overshoot drive, wherein, under the overshoot drive, the correction frame signal generating device selects a smaller gradation level for the pixels whose gradation levels of the image signals in the previous and following frames of the correction frame to be generated are different, while selecting the same gradation level for the pixels whose gradation levels are the same, and sets the gradation levels of each pixel to the selected levels so as to generate the image signal of the correction frame.

This makes it possible to decrease the ununiformity of the pixel response caused due to the delay in starting the response of the liquid crystal because of the overshoot drive.

Next, an image displaying method of the present invention is an image displaying method for a liquid crystal display device which includes a liquid crystal panel including a plurality of pixels arranged in a lattice form. The method includes: inputting image signals from outside; generating an image signal of a correction frame for reducing a response delay of a pixel based on image signals of one frame and a frame one before among the inputted image signals; and displaying, on the liquid crystal panel, a state where the correction frame is inserted between that one frame and the frame one before.

Further, in the above-described image displaying method, when generating the correction frame signal, pixel gradation levels defined by the image signals of that one frame and the frame one before are compared, and a gradation level suited for reducing the response delay of the pixel is selected and set, for each pixel, from those gradation levels to generate the image signal of the correction frame.

Furthermore, in the above-described image displaying method, the frame frequency of the inputted signal may be converted to a frame frequency of n (n>1) times after the input of the image signal.

Moreover, before generating the correction frame signal, the above-described image displaying method may include: temporarily storing information of one frame of the inputted image signals that are inputted successively by each frame; and inputting the image signal of that one frame among the inputted image signals, while reading out the image signal of the frame one before that one frame, which is stored in the frame memory.

Further, in a case where the pixel display mode of the liquid crystal panel is normally-white with the above-described image displaying method, when generating the correction frame signal, a larger gradation level may be selected for the pixels whose gradation levels of the image signals in the previous and following frames are different, and the same gradation level may be selected for the pixels whose gradation levels are the same to set the gradation levels of each pixel to the selected levels so as to generate the image signal of the correction frame.

Furthermore, in a case where the pixel display mode of the liquid crystal panel is normally-black with the above-described image displaying method, when generating the correction frame signal, a smaller gradation level may be selected for the pixels whose gradation levels of the image signals in the previous and following frames are different, and the same gradation level may be selected for the pixels whose gradation levels are the same to set the gradation levels of each pixel to the selected levels so as to generate the image signal of the correction frame.

Further, in a case where the liquid crystal panel is an VA-type and an overshoot control for correcting the image signal so that the liquid crystal panel executes an overshoot drive is performed before displaying the image in the above-described image displaying method, when generating the correction frame signal, a larger gradation level may be selected for the pixels whose gradation levels of the image signals in the previous and following frames are different, and the same gradation level may be selected for the pixels whose pixel gradation levels are the same to set the gradation levels of each pixel to the selected levels so as to generate the image signal of the correction frame.

Furthermore, in a case where the liquid crystal panel is an TN-type and an overshoot control for correcting the image signal so that the liquid crystal panel executes an overshoot drive is performed before displaying the image in the above-described image displaying method, when generating the correction frame signal, a smaller gradation level may be selected for the pixels whose gradation levels of the image signals in the previous and following frames are different, and the same gradation level may be selected for the pixels whose gradation levels are the same to set the gradation levels of each pixel to the selected levels so as to generate the image signal of the correction frame.

Like the above-described liquid crystal display device, it is possible with such image displaying method to generate the correction frame (that works to reduce the delay of a pixel whose response has a lag when the frame is switched in the image display) based on the frames before and after the switching, and to display the image by inserting the correction frame between the previous and following frames. Therefore, it is possible to decrease the ununiformity in the response of the pixels caused by the delay in the transition speed because of the viscosity of the liquid crystal, a delay in starting the response of the liquid crystal because of the overshoot drive, and the like.

Next, an image displaying program of the present invention allows a computer that controls a liquid crystal display device which includes a liquid crystal panel including a plurality of pixels arranged in a lattice form to execute: image signal input processing for inputting image signals from outside; correction frame signal generating processing for generating an image signal of a correction frame for reducing a response delay of a pixel based on image signals of one frame and a frame one before among the inputted image signals; and image displaying processing for displaying, on the liquid crystal panel, a state where the correction frame is inserted between that one frame and the frame one before.

Further, the content of the above-described image displaying program regarding the above-described correction frame signal generating processing may be so specified that pixel gradation levels defined by the image signals of that one frame and the frame one before are compared, and a gradation level suited for reducing the response delay of the pixel is selected and set, for each pixel, from those gradation levels to generate the image signal of the correction frame.

Furthermore, the above-described image displaying program may allow the computer to execute frequency conversion processing for converting the frame frequency of the image signal to a frame frequency of n (n>1) times.

Moreover, the above-described image displaying program may allow the computer to execute: frame memory processing for temporarily storing information of one frame of the inputted image signals that are inputted successively by each frame; and image signal readout processing for inputting the image signal of that one frame among the inputted image signals, while reading out the image signal of the frame one before that one frame, which is stored in the frame memory.

Further, in a case where the pixel display mode of the liquid crystal panel is normally-white, the content of the above-described image displaying program regarding the above-described correction frame signal generating processing may be so specified that a larger gradation level is selected for the pixels whose gradation levels of the image signals in the previous and following frames are different, and the same gradation level is selected for the pixels whose gradation levels are the same to set the gradation levels of each pixel to the selected levels so as to generate the image signal of the correction frame.

Furthermore, in a case where the pixel display mode of the liquid crystal panel is normally-black, the content of the above-described image displaying program regarding the above-described correction frame signal generating processing may be so specified that a smaller gradation level is selected for the pixels whose gradation levels of the image signals in the previous and following frames are different, and the same gradation level is selected for the pixels whose gradation levels are the same to set the gradation levels of each pixel to the selected levels so as to generate the image signal of the correction frame.

Further, when the above-described image displaying program allows the computer to execute overshoot control processing for correcting the image signal to execute an overshoot drive in a case where the liquid crystal panel is a VA-type, the content thereof regarding the above-described correction frame signal generating processing may be so specified that a larger gradation level is selected for the pixels whose gradation levels of the image signals in the previous and following frames are different, and the same gradation level is selected for the pixels whose gradation levels are the same to set the gradation levels of each pixel to the selected levels so as to generate the image signal of the correction frame.

Furthermore, when the above-described image displaying program allows the computer to execute overshoot control processing for correcting the image signal to execute an overshoot drive in a case where the liquid crystal panel is a TN-type, the content thereof regarding the above-described correction frame signal generating processing may be so specified that a smaller gradation level is selected for the pixels whose gradation levels of the image signals in the previous and following frames are different, and the same gradation level is selected for the pixels whose gradation levels are the same to set the gradation levels of each pixel to the selected levels so as to generate the image signal of the correction frame.

Like the above-described liquid crystal display device, it is possible with such image displaying program to generate the correction frame (that works to reduce the delay of a pixel whose response has a lag when the frame is switched in the image display) based on the frames before and after the switching, and to display the image by inserting the correction frame between the previous and following frames. Therefore, it is possible to decrease the ununiformity in the response of the pixels caused by the delay in the transition speed because of the viscosity of the liquid crystal, a delay in starting the response of the liquid crystal because of the overshoot drive, and the like.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A liquid crystal display means for displaying image signals on a liquid crystal panel with a plurality of pixels by switching a screen for each frame, the means comprising:

a frame frequency converting means for multiplying a frame frequency of an inputted image signal; and a correction frame signal generating means for generating an image signal of a correction frame based on gradation changes in the image signals of previous and following inputted frames, and displaying the correction frame between corresponding previous and following frames to make a size of a blur uniform in a displayed image, wherein, in a case where the liquid crystal means has such a characteristic that there is a delay when switching a display of from dark to bright, the correction frame signal generating means compares pixel data of the previous and following inputted frames to select a larger gradation value of i) the pixel data of the previous and ii) the pixel data of the following inputted frame, and generates the image signal of the correction frame by taking the selected larger gradation value as pixel data of the correction frame.

2. An image displaying method for displaying an image on a liquid crystal panel that includes a plurality of pixels, the method comprising:

converting a frame frequency of an input image signal by multiplying the frame frequency;

generating an image signal of a correction frame based on gradation changes in the image signals of previous and following inputted frames; and displaying an image on the liquid crystal panel by making a size of the blur uniform in a moving picture through inserting the correction frame between corresponding previous and following frames, wherein, in a case where the liquid crystal panel has such a characteristic that there is a delay when switching a display of from dark to bright, the step of generating the image signal of the correction frame compares pixel data of the previous and following inputted frames to select a larger gradation value of i) the pixel data of the previous and ii) the pixel data of the following inputted frame and generates the image signal of the correction frame by taking the selected larger gradation value as pixel data of the correction frame.

3. The image displaying method as claimed in claim 2, comprising:

controlling overshoot for converting the image signal to achieve an overshoot drive, after generating the correction frame signal.

4. An image displaying method for displaying an image on a liquid crystal panel that includes a plurality of pixels, the method comprising:

converting a frame frequency of an input image signal by multiplying the frame frequency;

generating an image signal of a correction frame based on gradation changes in the image signals of previous and following inputted frames; and displaying an image on the liquid crystal panel by making a size of the blur uniform in a moving picture through inserting the correction frame between corresponding previous and following frames, wherein, in a case where the liquid crystal panel has such a characteristic that there is a delay when switching a display from bright to dark, when generating the correction frame signal, pixel data of the previous and following inputted frames are compared to select a smaller gradation value of i) the pixel data of the previous and ii) the pixel data of the following inputted frame, and the image signal of the correction frame is generated by taking the selected smaller gradation value as pixel data of the correction frame.

5. An image displaying method for displaying an image on a liquid crystal panel that includes a plurality of pixels, the method comprising:

converting a frame frequency of an input image signal by multiplying the frame frequency;

generating an image signal of a correction frame based on gradation changes in the image signals of previous and following inputted frames;

displaying an image on the liquid crystal panel by making a size of the blur uniform in a moving picture through inserting the correction frame between corresponding previous and following frames; and controlling overshoot for converting the image signal to achieve an overshoot drive, after generating the correction frame signal, wherein, in a case where the liquid crystal panel has such a characteristic that there is a delay in a rise when pixel display is switched from dark to bright under the overshoot drive, when generating the correction frame, pixel data of the previous and following inputted frames are compared when executing the overshoot drive to select a larger gradation value of i) the pixel data of the previous and ii) the pixel data of the following inputted frame, and the image signal of the correction frame is generated by taking the selected larger gradation value as pixel data of the correction frame.

6. An image displaying method for displaying an image on a liquid crystal panel that includes a plurality of pixels, the method comprising:

converting a frame frequency of an input image signal by multiplying the frame frequency;

generating an image signal of a correction frame based on gradation changes in the image signals of previous and following inputted frames; and displaying an image on the liquid crystal panel by making a size of the blur uniform in a moving picture through inserting the correction frame between corresponding previous and following frames; and controlling overshoot for converting the image signal to achieve an overshoot drive, after generating the correction frame signal, wherein, in a case where the liquid crystal panel has such a characteristic that there is a delay in a rise when pixel display is switched from bright to dark under the overshoot drive, when generating the correction frame signal, pixel data of the previous and following inputted frames are compared when executing the overshoot drive to select a smaller gradation value of i) the pixel data of the previous and ii) the pixel data of the following inputted frame, and the image signal of the correction frame is generated by taking the selected smaller gradation value as pixel data of the correction frame.

7. A non-transitory computer readable medium having encoded thereon an image displaying program, upon being executed by a computer the image display program causing the computer to execute:

a frame frequency converting function which multiplies a frame frequency of an inputted image signal;

a correction frame image signal generating function which generates an image signal of a correction frame based on gradation changes in image signals of previous and following inputted frames; and a displaying function which displays an image on a liquid crystal panel by making a size of a blur uniform in a moving picture through inserting the correction frame between corresponding previous and following frames, wherein the program further causes the computer to execute the correction frame signal generating function by making it as a function which compares pixel data of the previous and following inputted frames to select a larger gradation value of i) the pixel data of the previous and ii) the pixel data of the following inputted frame, and generates the image signal of the correction frame by taking the selected larger gradation value as pixel data of the correction frame, in a case where the liquid crystal panel has such a characteristic that there is a delay when switching a display from dark to bright.

8. The non-transitory computer readable medium as claimed in claim 7, wherein the program further causes the computer to execute an overshoot control function which converts the image signal for achieving an overshoot drive.

9. A non-transitory computer readable medium having encoded thereon an image displaying program, upon being executed by a computer the image display program causing the computer to execute:

a frame frequency converting function which multiplies a frame frequency of an inputted image signal;

a correction frame image signal generating function which generates an image signal of a correction frame based on gradation changes in image signals of previous and following inputted frames; and a displaying function which displays an image on a liquid crystal panel by making a size of a blur uniform in a moving picture through inserting the correction frame between corresponding previous and following frames, wherein the program further causes the computer to execute the correction frame signal generating function by making it as a function which compares pixel data of the previous and following inputted frames to select a smaller gradation value of i) the pixel data of the previous and ii) the pixel data of the following inputted frame, and generates the image signal of the correction frame by taking the selected smaller gradation value as pixel data of the correction frame, in a case where the liquid crystal panel has such a characteristic that there is a delay when switching a display from bright to dark.

10. A non-transitory computer readable medium having encoded thereon an image displaying program, upon being executed by a computer the image display program causing the computer to execute:

a frame frequency converting function which multiplies a frame frequency of an inputted image signal;

a correction frame image signal generating function which generates an image signal of a correction frame based on gradation changes in image signals of previous and following inputted frames; and a displaying function which displays an image on a liquid crystal panel by making a size of a blur uniform in a moving picture through inserting the correction frame between corresponding previous and following frames, wherein the program further causes the computer to execute an overshoot control function which converts the image signal for achieving an overshoot drive, and wherein the program further causes the computer to execute the correction frame signal generating function by making it as a function which compares pixel data of the previous and following inputted frames when executing an overshoot drive to select a larger gradation value of i) the pixel data of the previous and ii) the pixel data of the following inputted frame, and generates the image signal of the correction frame by taking the selected larger gradation value as pixel data of the correction frame, in a case where the liquid crystal panel has such a characteristic that there is a delay in a rise when pixel display is switched from dark to bright under the overshoot drive.

11. A non-transitory computer readable medium having encoded thereon an image displaying program, upon being executed by a computer the image display program causing the computer to execute:

a frame frequency converting function which multiplies a frame frequency of an inputted image signal;

a correction frame image signal generating function which generates an image signal of a correction frame based on gradation changes in image signals of previous and following inputted frames; and a displaying function which displays an image on a liquid crystal panel by making a size of a blur uniform in a moving picture through inserting the correction frame between corresponding previous and following frames, wherein the program further causes the computer to execute an overshoot control function which converts the image signal for achieving an overshoot drive, and wherein the program further causes the computer to execute the correction frame signal generating function by making it as a function which compares pixel data of the previous and following inputted frames when executing an overshoot drive to select a larger gradation value of i) the pixel data of the previous and ii) the pixel data of the following inputted frame, and generates the image signal of the correction frame by taking the selected smaller gradation value as pixel data of the correction frame, in a case where the liquid crystal panel has such a characteristic that there is a delay in a rise when pixel display is switched from bright to dark under the overshoot drive.

12. A liquid crystal display device for displaying image signals on a liquid crystal panel with a plurality of pixels by switching a screen for each frame, the device comprising:

a frame frequency converting part for dividing the one flame into two or more flames by multiplying a frame frequency of an inputted image signal;

a correction frame signal generating device for generating an image signal of a correction frame based on gradation changes in the image signals of previous and following inputted frames, and displaying the correction frame between corresponding previous and following frames to output the image signal, the image signal of the correction frame, and the following image signal successively; and wherein, in a case where the liquid crystal panel has such a characteristic that a more delay is caused when switching a display of from dark to bright compared to when switching a display from bright to dark, the correction frame signal generating device generates the image signal of the correction frame by taking a larger gradation value, from pixel data of the previous and following inputted frames, as pixel data of the correction frame.

13. The liquid crystal display device as claimed in claim 12, comprising an overshoot control part which converts the image signal for achieving an overshoot drive, at a later stage of the correction frame signal generating device.

14. A liquid crystal display device for displaying image signals on a liquid crystal panel with a plurality of pixels by switching a screen for each frame, the device comprising:

a frame frequency converting part for dividing the one flame into two or more flames by multiplying a frame frequency of an inputted image signal; and a correction frame signal generating device for generating an image signal of a correction frame based on gradation changes in the image signals of previous and following inputted frames, and displaying the correction frame between corresponding previous and following frames output the image signal, the image signal of the correction frame, and the following image signal successively, wherein, in a case where the liquid crystal panel has such a characteristic that a more delay is caused when switching a display from bright to dark compared to when switching a display from dark to bright, the correction frame signal generating device generates the image signal of the correction frame by taking a smaller gradation value, from pixel data of the previous and following inputted frames, as pixel data of the correction frame.

15. The liquid crystal display device as claimed in claim 14, comprising an overshoot control part which converts the image signal for achieving an overshoot drive, at a later stage of the correction frame signal generating device.

16. A liquid crystal display device for displaying image signals on a liquid crystal panel with a plurality of pixels by switching a screen for each frame, the device comprising:

a frame frequency converting part for multiplying a frame frequency of an inputted image signal;

a correction frame signal generating device for generating an image signal of a correction frame based on gradation changes in the image signals of previous and following inputted frames, and displaying the correction frame between corresponding previous and following frames output the image signal, the image signal of the correction frame, and the following image signal successively; and an overshoot control part which converts the image signal for achieving an overshoot drive, at a later stage of the correction frame signal generating device, wherein, in a case where the liquid crystal panel has such a characteristic that a more delay is caused in a rise when pixel display is switched from dark to bright compared to when the pixel display is switched from bright to dark under the overshoot drive, the correction frame signal generating device generates, when executing the overshoot drive, the image signal of the correction frame by taking a larger gradation value, from pixel data of the previous and following inputted frames, as pixel data of the correction frame.

17. A liquid crystal display device for displaying image signals on a liquid crystal panel with a plurality of pixels by switching a screen for each frame, the device comprising:

a frame frequency converting part for dividing the one flame into two or more flames by multiplying a frame frequency of an inputted image signal;

a correction frame signal generating device for generating an image signal of a correction frame based on gradation changes in the image signals of previous and following inputted frames, and displaying the correction frame between corresponding previous and following frames output the image signal, the image signal of the correction frame, and the following image signal successively; and an overshoot control part which converts the image signal for achieving an overshoot drive, at a later stage of the correction frame signal generating device, wherein, in a case where the liquid crystal panel has such a characteristic that a more delay is caused in a rise when pixel display is switch from bright to dark compared to when the pixel display is switched from dark to bright under the overshoot drive, the correction frame signal generating device generates, when executing the overshoot drive, the image signal of the correction frame by taking a smaller gradation value, from pixel data of the previous and following inputted frames, as pixel data of the correction frame.

18. A liquid crystal display method for displaying image signals on a liquid crystal panel with a plurality of pixels by switching a screen for each frame, the method comprising:

dividing the one flame into two or more flames by multiplying a frame frequency of an inputted image signal;

generating an image signal of a correction frame based on gradation changes in the image signals of previous and following inputted frames, and displaying the correction frame between corresponding previous and following frames to output the image signal, the image signal of the correction frame, and the following image signal successively; and in a case where the liquid crystal panel has such a characteristic that a more delay is caused when switching a display from dark to bright compared to when switching a display from bright to dark, generating the image signal of the correction frame by taking a larger gradation value, from pixel data of the previous and following inputted frames, as pixel data of the correction frame.

19. A liquid crystal display method for displaying image signals on a liquid crystal panel with a plurality of pixels by switching a screen for each frame, the method comprising:

dividing the one flame into two or more flames by multiplying a frame frequency of an inputted image signal;

generating an image signal of a correction frame based on gradation changes in the image signals of previous and following inputted frames, and displaying the correction frame between corresponding previous and following frames to output the image signal, the image signal of the correction frame, and the following image signal successively; and in a case where the liquid crystal panel has such a characteristic that a more delay is caused when switching a display from bright to dark compared to when switching a display from dark to bright, generating the image signal of the correction frame by taking a smaller gradation value, from pixel data of the previous and following inputted frames, as pixel data of the correction frame.

20. A liquid crystal display method for displaying image signals on a liquid crystal panel with a plurality of pixels by switching a screen for each frame, the method comprising:

dividing the one flame into two or more flames by multiplying a frame frequency of an inputted image signal;

generating an image signal of a correction frame based on gradation changes in the image signals of previous and following inputted frames, and displaying the correction frame between corresponding previous and following frames to output the image signal, the image signal of the correction frame, and the following image signal successively;

converting the successively outputted image signal for achieving an overshoot drive; and in a case where the liquid crystal panel has such a characteristic that a more delay is caused in a rise when pixel display is switched from dark to bright compared to when the pixel display is switched from bright to dark under the overshoot drive, generating, when executing the overdrive shoot, the image signal of the correction frame by taking a larger gradation value, from pixel data of the previous and following inputted frames, as pixel data of the correction frame.

21. A liquid crystal display method for displaying image signals on a liquid crystal panel with a plurality of pixels by switching a screen for each frame, the method comprising:

dividing the one flame into two or more flames by multiplying a frame frequency of an inputted image signal;

generating an image signal of a correction frame based on gradation changes in the image signals of previous and following inputted frames, and displaying the correction frame between corresponding previous and following frames to output the image signal, the image signal of the correction frame, and the following image signal successively;

converting the successively outputted image signal for achieving an overshoot drive; and in a case where the liquid crystal panel has such a characteristic that a more delay is caused in a rise when pixel display is switched from bright to dark compared to when the pixel display is switched from dark to bright under the overshoot drive, generating, when executing the overdrive shoot, the image signal of the correction frame by taking a smaller gradation value, from pixel data of the previous and following inputted frames, as pixel data of the correction frame.

22. A non-transitory computer readable recording medium storing a program for displaying image signals on a liquid crystal panel with a plurality of pixels by switching a screen for each frame, which causes a computer to execute:

a function of dividing the one flame into two or more flames by multiplying a frame frequency of an inputted image signal;

a function of generating an image signal of a correction frame based on gradation changes in the image signals of previous and following inputted frames, and displaying the correction frame between corresponding previous and following frames to output the image signal, the image signal of the correction frame, and the following image signal successively; and a function of, in a case where the liquid crystal panel has such a characteristic that a more delay is caused when switching a display from dark to bright compared to when switching a display from bright to dark, generating the image signal of the correction frame by taking a larger gradation value, from pixel data of the previous and following inputted frames, as pixel data of the correction frame.

23. A non-transitory computer readable recording medium storing a program for displaying image signals on a liquid crystal panel with a plurality of pixels by switching a screen for each frame, which causes a computer to execute:

a function of dividing the one flame into two or more flames by multiplying a frame frequency of an inputted image signal;

a function of generating an image signal of a correction frame based on gradation changes in the image signals of previous and following inputted frames, and displaying the correction frame between corresponding previous and following frames to output the image signal, the image signal of the correction frame, and the following image signal successively; and a function of, in a case where the liquid crystal panel has such a characteristic that a more delay is caused when switching a display from bright to dark compared to when switching a display from dark to bright, generating the image signal of the correction frame by taking a smaller gradation value, from pixel data of the previous and following inputted frames, as pixel data of the correction frame.

24. A non-transitory computer readable recording medium storing a program for displaying image signals on a liquid crystal panel with a plurality of pixels by switching a screen for each frame, which causes a computer to execute:

a function of dividing the one flame into two or more flames by multiplying a frame frequency of an inputted image signal;

a function of generating an image signal of a correction frame based on gradation changes in the image signals of previous and following inputted frames, and displaying the correction frame between corresponding previous and following frames to output the image signal, the image signal of the correction frame, and the following image signal successively;

a function of converting the successively outputted image signal for achieving an overshoot drive; and a function of, in a case where the liquid crystal panel has such a characteristic that a more delay is caused in a rise when pixel display is switched from dark to bright compared to when the pixel display is switched from bright to dark under the overshoot drive, generating, when executing the overdrive shoot, the image signal of the correction frame by taking a larger gradation value, from pixel data of the previous and following inputted frames, as pixel data of the correction frame.

25. A non-transitory computer readable recording medium storing a program for displaying image signals on a liquid crystal panel with a plurality of pixels by switching a screen for each frame, which causes a computer to execute:

a function of dividing the one flame into two or more flames by multiplying a frame frequency of an inputted image signal;

a function of generating an image signal of a correction frame based on gradation changes in the image signals of previous and following inputted frames, and displaying the correction frame between corresponding previous and following frames to output the image signal, the image signal of the correction frame, and the following image signal successively;

a function of converting the successively outputted image signal for achieving an overshoot drive; and a function of, in a case where the liquid crystal panel has such a characteristic that a more delay is caused in a rise when pixel display is switched from bright to dark compared to when the pixel display is switched from dark to bright under the overshoot drive, generating, when executing the overdrive shoot, the image signal of the correction frame by taking a smaller gradation value, from pixel data of the previous and following inputted frames, as pixel data of the correction frame.

* * * * *